US010252142B2

(12) United States Patent
Thoman et al.

(10) Patent No.: US 10,252,142 B2
(45) Date of Patent: Apr. 9, 2019

(54) TABLE TENNIS ROBOT WITH IMPROVED SERVING HEAD MOVEMENT

(71) Applicant: Newgy Industries, Inc., Hendersonville, TN (US)

(72) Inventors: Lawrence Michael Thoman, Gallatin, TN (US); Burak Cevik, Cincinnati, OH (US)

(73) Assignee: NEWGY INDUSTRIES, INC., Hendersonville, TN (US)

( * ) Notice: Subject to any disclaimer, the term of this patent is extended or adjusted under 35 U.S.C. 154(b) by 0 days.

(21) Appl. No.: 15/123,598

(22) PCT Filed: Feb. 9, 2015

(86) PCT No.: PCT/US2015/014966

§ 371 (c)(1),
(2) Date: Sep. 2, 2016

(87) PCT Pub. No.: WO2015/134151

PCT Pub. Date: Sep. 11, 2015

(65) Prior Publication Data

US 2017/0072284 A1 Mar. 16, 2017

Related U.S. Application Data

(60) Provisional application No. 61/948,204, filed on Mar. 5, 2014.

(51) Int. Cl.
*A63B 47/02* (2006.01)
*A63B 69/40* (2006.01)
(Continued)

(52) U.S. Cl.
CPC ..... *A63B 71/0622* (2013.01); *A63B 47/02* (2013.01); *A63B 69/406* (2013.01);
(Continued)

(58) Field of Classification Search
CPC ... A63B 69/406; A63B 71/0622; A63B 47/02; A63B 2102/16; A63B 2069/402; A63B 2207/02; A63B 2220/17; A63B 2225/50
See application file for complete search history.

(56) References Cited

U.S. PATENT DOCUMENTS 2,157,583 A * 5/1939 Wisoff ..... A41G 1/04 140/93 R
2,169,978 A * 8/1939 Pearce ..... B31B 70/00 493/333

(Continued)

FOREIGN PATENT DOCUMENTS

EP 0503176 A1 12/1991
JP 1989-077784 U 5/1989

(Continued)

OTHER PUBLICATIONS

International Search Report for PCT application PCT/US2015/014966 dated Apr. 21, 2015.

(Continued)

*Primary Examiner* — Alvin A Hunter
*Assistant Examiner* — Amir A Klayman
(74) *Attorney, Agent, or Firm* — Sandberg Phoenix & Von Gontard PC

(57) ABSTRACT

A robot server assembly for serving table tennis balls comprising a body defining an internal ball path, means for introducing balls into the internal ball path at the lower end of the body; a ball guide at the upper end of the back panel, a serving head assembly at the upper end of the body having a ball discharge tube in communication with the ball guide; a pair of opposed discharge wheel operatively associated with the discharge tube; a plurality of gears associated with the serving head; at least one servo motor associated with at least one of the gears to actuate rotation of the gear; whereby actuation of a least one of said gears affects 180° rotation of (Continued)

the serving head about a longitudinal axis of the serving head, up and down movement of the serving head and side to side movement of the serving head.

14 Claims, 7 Drawing Sheets

(51) Int. Cl.
*A63B 71/06* (2006.01)
*A63B 102/16* (2015.01)

(52) U.S. Cl.
CPC ..... *A63B 2069/402* (2013.01); *A63B 2102/16* (2015.10); *A63B 2207/02* (2013.01); *A63B 2220/17* (2013.01); *A63B 2225/50* (2013.01)

(56) References Cited

U.S. PATENT DOCUMENTS

RE27,129 E * 6/1971 Lemelson ..... B25J 17/0241 414/728
3,948,542 A * 4/1976 Lukich ..... B62M 1/20 280/223
4,055,864 A * 11/1977 Liu ..... A47K 13/10 4/246.1
4,632,088 A * 12/1986 Bruce ..... A63B 69/406 124/6
4,655,190 A 4/1987 Harris
4,792,121 A * 12/1988 Annas, Sr. ..... B25H 1/00 254/11
4,844,458 A 7/1989 Gatchel et al.
4,886,269 A 12/1989 Marocco
5,046,476 A 9/1991 Nozato
5,178,123 A 1/1993 I-Chih
5,181,501 A * 1/1993 Lien ..... A63B 69/40 124/10
5,383,658 A 1/1995 Newgarden, Jr.
5,464,208 A 11/1995 Pierce
5,485,995 A * 1/1996 Newgarden, Jr. ..... A63B 67/04 124/1
5,607,151 A * 3/1997 Daley ..... F41B 4/00 124/78
5,676,588 A * 10/1997 Frederick ..... B24C 1/003 451/75
6,024,078 A * 2/2000 Hollis ..... F41B 4/00 124/78
6,082,350 A 7/2000 Crews et al.
6,237,583 B1 * 5/2001 Ripley ..... A63B 47/002 124/78
6,349,084 B1 * 2/2002 Ariyoshi ..... F16F 1/38 720/692
6,371,872 B1 * 4/2002 Daley ..... A63B 69/406 124/48
6,406,386 B1 * 6/2002 Brazzell ..... A63B 69/406 124/78
6,440,013 B1 8/2002 Brown
6,604,517 B1 8/2003 Chao et al.
7,213,724 B1 * 5/2007 Langer ..... A63B 69/407 221/236
7,736,249 B2 * 6/2010 Zhang ..... A63B 69/406 124/78
9,448,031 B2 * 9/2016 Wijegunawardana .... F41B 4/00
9,789,379 B1 * 10/2017 Bynum ..... A63B 69/406
2003/0193874 A1 * 10/2003 Ariyoshi ..... G11B 17/0288 720/635
2007/0221187 A1 9/2007 Chen
2007/0238555 A1 * 10/2007 Fang ..... A63B 67/04 473/431
2009/0011872 A1 1/2009 Zhang
2009/0260612 A1 * 10/2009 Grant ..... A63B 69/406 124/78
2012/0196707 A1 * 8/2012 Thoman ..... A63B 69/406 473/436

FOREIGN PATENT DOCUMENTS

WO 9411069 5/1994
WO 2006101488 A1 9/2006
WO 2011-056641 A2 5/2011
WO 2015134151 A1 9/2015

OTHER PUBLICATIONS

Written Opinion of the International Search Authority for PCT application PCT/US2015/014966 dated Apr. 21, 2015.
Japanese Official Action of corresponding Japanese application No. 2016-573646 dispatched Aug. 22, 2017.
English Translation of Notification of Reasons for Rejection (translation of Office Action) for corresponding Japanese application No. 2016-573646 dispatched Aug. 22, 2017.
Supplementary European Search Report for corresponding application No. EP 15757708.1 dated Oct. 5, 2017.
Written Opinion of the International Search Authority for Singapore Patent Application No. 11201607207R dated Aug. 8, 2017.
Examination Search Report of the Canadian Searching Authority for Canadian Patent Application 2,941,607 dated Aug. 10, 2017.
European Substantive Examination by the EPO of the corresponding European Application No. 15757708.1 dispatched Jul. 27, 2018.
Office Action of corresponding Canadian Application No. 2941607 dispatched May 4, 2018.
Official Action of corresponding Chinese application No. 201580011871.6 dispatched Mar. 16, 2018.
Official Action of corresponding Korean application No. 10-2016-7027610 dispatched Mar. 13, 2018.

* cited by examiner

TABLE TENNIS ROBOT WITH IMPROVED SERVING HEAD MOVEMENT

RELATED APPLICATIONS

This application derives and claims priority from International Application PCT/US2015/014966, filed Feb. 9, 2015, and published under International Publication Number WO 2015/134151 A1, and from U.S. provisional application 61/948,204, filed Mar. 5, 2014, which is incorporated herein by reference.

BACKGROUND

This disclosure relates to a robot server assembly for serving table tennis balls, and more specifically to a robot server assembly that has improved head movement allowing for varied trajectories of discharge of a table tennis ball.

Table tennis is a popular competitive and recreational sport. The object of the game is to have a player on each side of the table so that each player with a table tennis paddle can serve, return and rally a table tennis ball. Often, however, a player may wish to play the game of table tennis without another player. To that end, various table tennis ball serving devices or robots have been developed. The devices serve the ball to the player so that the player can return the shot in the direction of the robot.

Heretofore table tennis robots have incorporated various features. U.S. Pat. No. 3,794,011 to Newgarden describes a relatively simple device for imparting variations in the amount of spin applied to a ball being served by the server. The disclosure of the U.S. Pat. No. 3,794,011 is incorporated herein by reference.

U.S. Pat. No. 4,844,458 is directed to a table tennis robot with a panning head; U.S. Pat. No. 4,854,588 describes a table tennis robot capable of variations in shot trajectory; U.S. Pat. No. 4,917,380 discloses a table tennis robot having lateral, foldable troughs with a net array that captures balls, allows them to drop to the troughs where they are fed to the robot server; and U.S. Pat. No. 5,009,421 discloses a portable table tennis serving devices that include a robot server and a ball capture net. These last two recited patents employ a folding net structure is also employed for attachment to a table tennis table and for feeding balls to a robot ball server. The net structure includes a plurality of arms extending radially from a central member and netting suspended between the arms. The netting has a lower edge, which is cooperatively connected with a trough device for receiving balls that fall from the netting. The trough is disposed to feed the balls to the robot serving device. The disclosures in the above described patents are incorporated by reference herein.

While the devices previously known to the art are functional and useful, they can be limited in the way the ball is discharged from the robot head. That is for the most part they are panning heads that move back and forth and vary the speed of trajectory and the like. However, they have limited ways of varying the trajectory of the discharged ball, the angle of trajectory, the spin on the ball and so forth, primarily due to the weight of conventional panning heads.

It is desirable, therefore, to have a sophisticated server device for sequentially serving a plurality of balls to the player employing a relatively simple, inexpensive lightweight design with improved or expanded trajectories of discharge.

SUMMARY OF THE DISCLOSURE

Briefly stated, a robot table tennis ball server assembly is disclosed.

In one aspect, the robot table tennis ball server assembly comprises a serving head assembly that ejects the table tennis balls through a discharge tube. In one aspect, the serving head assembly has full movement, i.e. the head can move along a vertical path, a horizontal path and can rotate 360° around the longitudinal axis of the discharge tube.

In one aspect, the serving head assembly comprises a ball discharge tube, a top discharge wheel and an opposed bottom discharge wheel, both of which extend at least partway into the tube. The discharge wheels comprise a lightweight plastic material. Each of the discharge wheels includes an axle and an outer rim at each end of the axle. Each rim seats a silicon O-ring. In one aspect, the axle of the top wheel is narrower than the axle of the bottom wheel. Moreover, the axle and rims of the bottom wheel define a substantially concave configuration, which better seats and stabilizes a ball. The top wheel grips the ball with a narrower grip than the bottom wheel, stabilizing the ball and allowing more accurate control of expulsion including desired speed and spin.

In one aspect, the discharge tube has a posterior section and an overlapping anterior section with an O-ring bearing at the junction of the two sections to provide a smooth, lightweight surface for rotational movement of the server head about the longitudinal axis of the discharge tube.

In another aspect, the operative elements of the serving head assembly comprise lightweight materials, which allow a wide range of movements of the serving head by small servo motors.

In another aspect, the movement of the server head is controlled by a wireless unit, which can be handheld or mounted on the table. In one aspect, the unit is a programmable tablet computer.

Yet another aspect of the disclosure is a robot server assembly that can be expanded to accept a net assembly or trough assembly.

DETAILED DESCRIPTION

Figure 1:
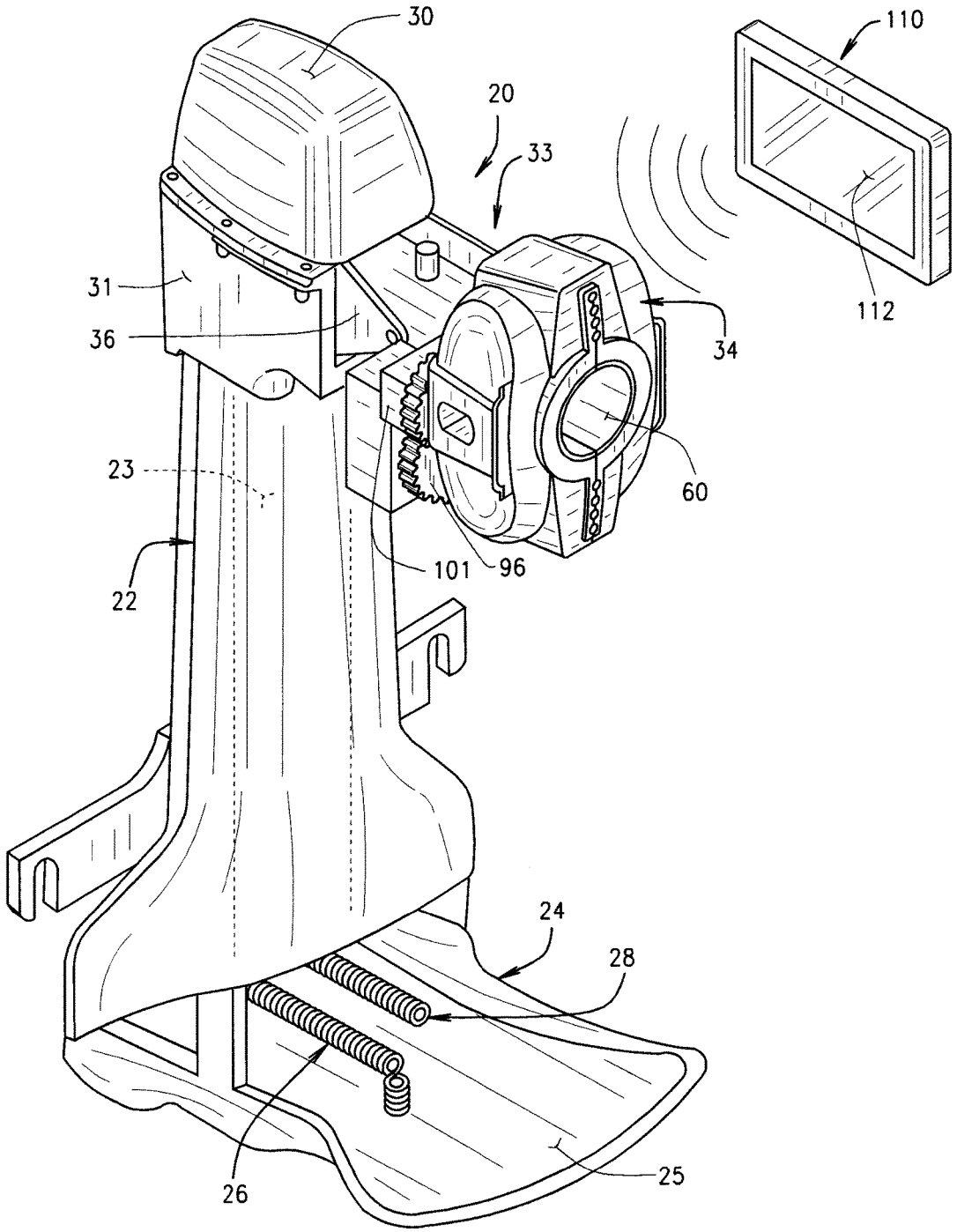
FIG. 1 is a perspective view of the robot table tennis ball server assembly in accordance with the present disclosure positioned adjacent to a programmable tablet controller.

While this disclosure is susceptible of embodiment in many different forms, there is shown in the drawings and will herein be described in detail preferred embodiments of the disclosure with the understanding that the present disclosure is to be considered as an exemplification of the principles of the disclosure and is not intended to limit the broad aspect of the disclosure to the embodiments illustrated.

Referring now to the drawing figures, one illustrative embodiment of a robot table tennis ball server assembly 20 is shown. Robot table tennis ball server assembly 20 contains an elongated body 22 that defines an internal ball channel 23. A rounded ball collector apparatus 24 is located at the bottom of the body and in communication with the ball channel. A ball feed collector plate 25 extends outwardly at a right angle from the bottom of body 22. A ball pickup mechanism 26 having a plurality of internal fingers (not seen) that pick up the balls and springs 28, which stir the balls and keep them from hanging up at the entry, is operatively associated with the ball collector mounting section 24.

Robot table tennis ball server assembly 20 includes a ball guide 29 in communication with ball channel 23. Ball guide 29 and the upper opening of channel 23 are normally covered by an oscillator cover 30 (FIG. 5) and enclosed in a ball guide housing 31. As shown, ball guide housing 31 is a substantially rectangular structure defined by four walls. However, the front wall includes a ball outlet 32. Other components located within cover 30 will be described below. Robot table tennis ball server assembly 20 includes a serving head assembly 33 at the top of body 22 and in operative communication with ball guide 29 and channel 23.

In one aspect, and in general, robot table tennis ball server assembly 20 operates as follows: balls flow into ball feed collector plate 25. The motor of the ball pickup mechanism causes the pickup wheel to rotate via the main and transfer gears. As the pickup wheel rotates, the plurality of springs 28 attached to the pickup wheel rotate, effectively separating balls as they feed into the bottom of the pickup mechanism. As each pickup finger (not seen) rotates to the bottom of the pickup mechanism it engages a ball and propels it upward into the ball channel. As balls build in the queue, they will move upward inside channel 23 of the body and into an upper ball guide 29.

A ball sensor switch may be employed to count each ball as it passes the switch. The sensor sends a signal to a digital controller to allow the digital controller to stop ball delivery after a specified number of balls. The digital controller can also accurately detect when there has been a missed ball pickup and then speed up the rotation of the ball pickup mechanism to maintain a constant flow of balls through the robot. Ball guide 29 directs the balls into the serving head assembly 33 for expulsion. Once inside serving head assembly 33 the balls are engaged by spinning discharge wheels, as will be explained below, and are expelled from serving head assembly 33, as will be explained in greater detail, below. In any event, one aspect of the ball collector and associated structures function, the ball guides, and the ball channel, as well as a representative embodiment of the function of the elements, is disclosed in the assignee's co-pending patent application Ser. No. 13/500,774, which is incorporated herein by reference. It will be understood that the operation of the robot table tennis ball server assembly, particularly the elements positioned below the serving head assembly, may operate in a different manner. Any robot structure that delivers table tennis balls to the serving head assembly is encompassed by the disclosure.

In general, robot server assembly 20 can be mounted in a container such as a ball bucket or basket or can be detachably mounted directly onto the edge of a table tennis table by employing attachment means as set out in U.S. Pat. No. 5,485,995, which is incorporated herein by reference. Robot server assembly 20 may be employed in a table tennis net and server assembly (not shown) of the type disclosed in U.S. Pat. No. 5,335,905, which is incorporated herein by reference. The robot server assembly of present invention may include lateral, foldable troughs with a net array that captures balls, allows them to drop to the troughs where they are fed to the robot server. The net structure includes a plurality of arms extending radially from a central member and netting suspended between the arms. The netting has a lower edge, which is cooperatively connected with the troughs for receiving balls that fall from the netting. The trough is disposed to feed the balls to the robot serving device.

Various aspects of serving head assembly 33 will be discussed in detail. Serving head assembly 33 includes a serving head 34, which is designed to vary the angle of delivery of the ball, speed of the ball and spin on the ball. Serving head assembly 33 is pivotally attached to ball guide housing 31, as will be explained below. In general, and referring to FIGS. 2 and 3, serving head assembly 33 defines a longitudinal axis A1. Serving head 34 can rotate 360° about longitudinal axis A1 as indicated by arrow B in FIG. 2. Furthermore, serving head assembly 33 can pivot up and down approximately 120° relative to vertical axis A2 as shown by arrow C. Moreover, serving head assembly 33 can pan back and forth or side-to-side approximately 180° relative to vertical axis A3 as indicated by arrow D.

Figure 3:
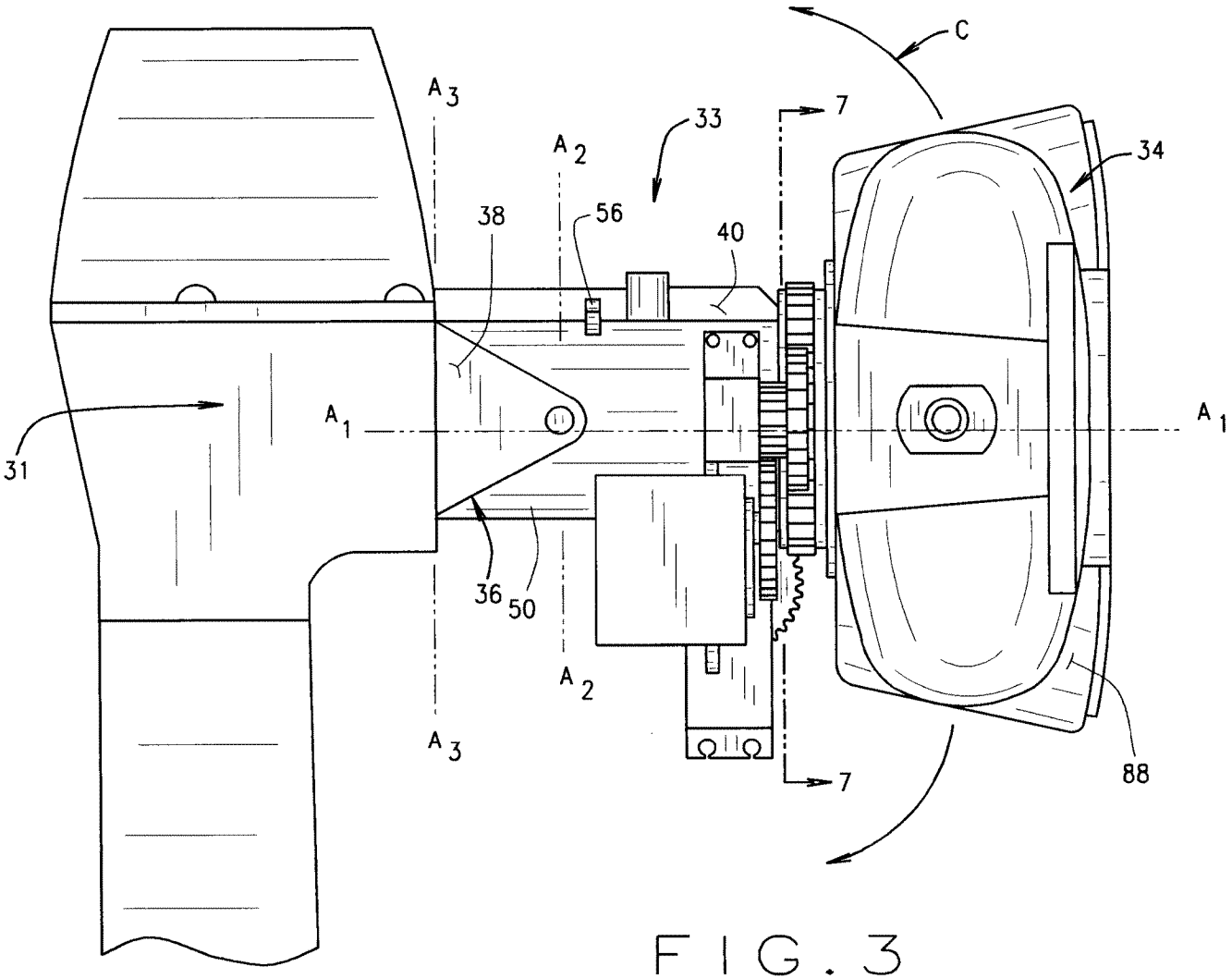
FIG. 3 is a left side elevational view of the serving head and gear assembly.
Figure 4:
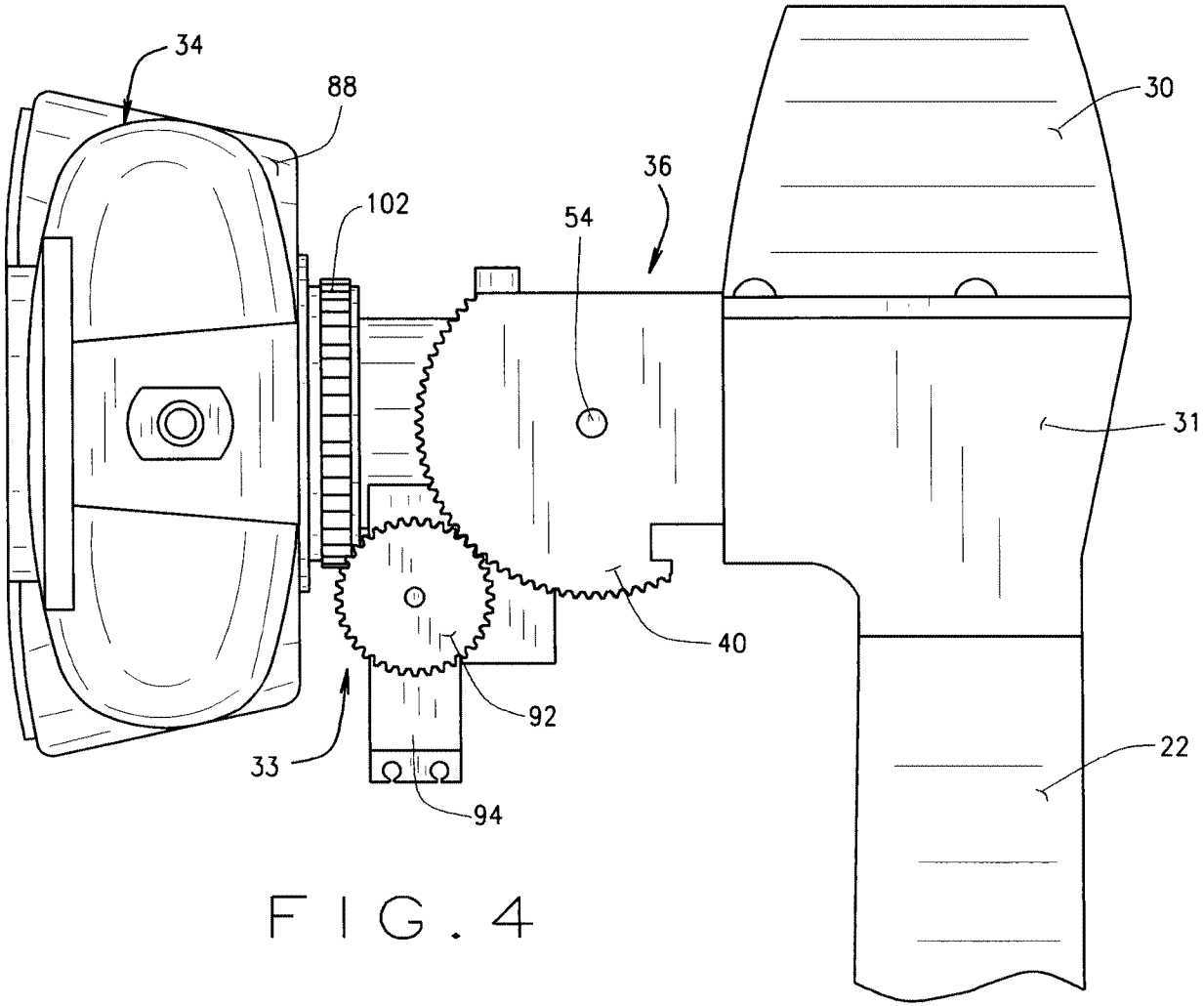
FIG. 4 is a right side elevational view of the serving head and gear assembly.
Figure 5:
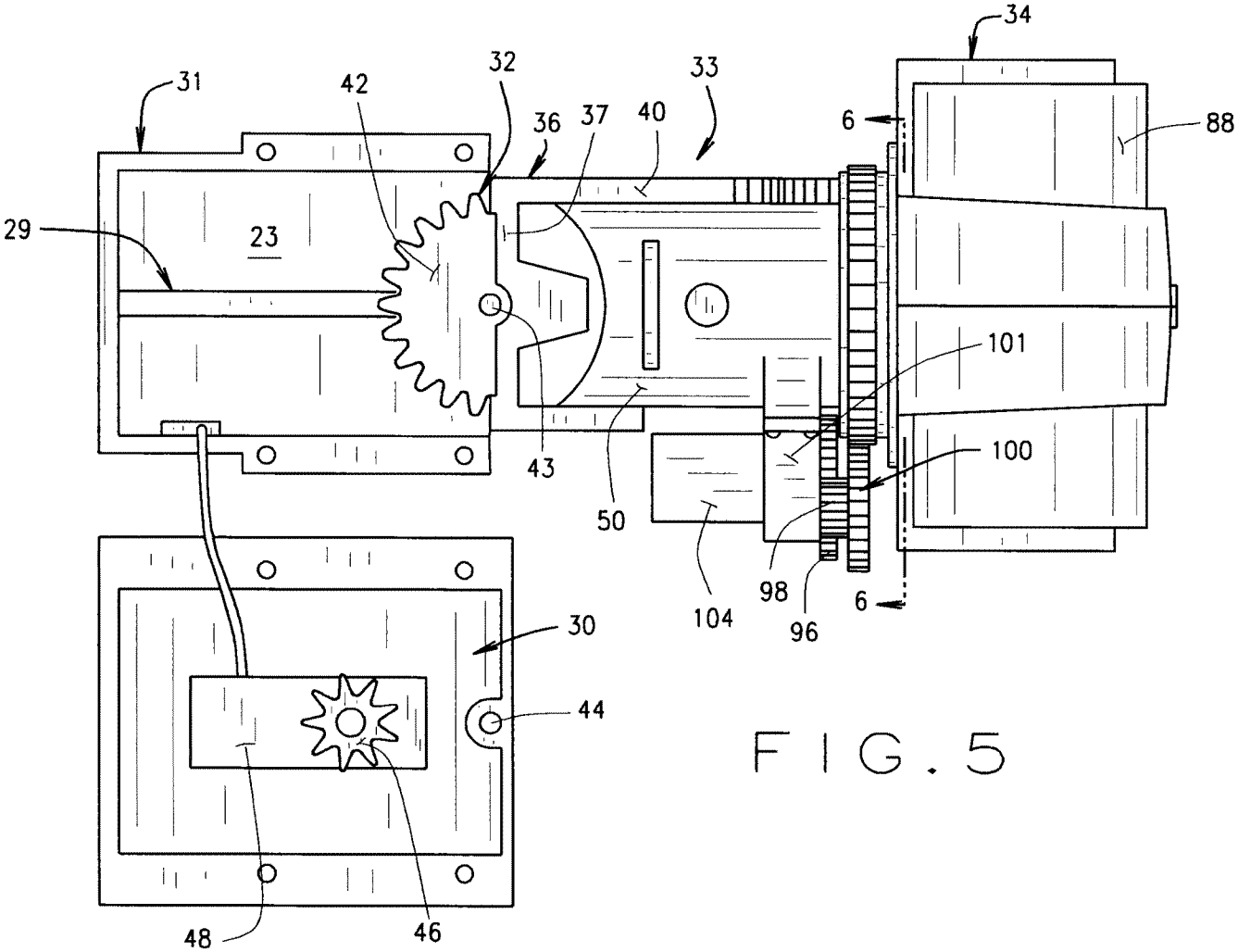
FIG. 5 is a top plan view with the oscillator cover removed and positioned upside down showing the bottom plan of the oscillator cover, panning drive gear and servo motor.

Referring to FIGS. 3 through 5, serving head assembly 33 is attached to ball guide housing 31 by bracket 36. Bracket 36 includes rear wall 37, an ear 38 on a first side of the wall and an arcuate gear 40 on the opposite side wall. Gear 40 extends about 120°. Wall 37 has a circular opening therein (not seen) complementary to opening 32 in the front wall of ball guide housing 31. It will be appreciated that the two openings are configured and dimensioned to allow the passage of a conventional table tennis ball.

As best seen in FIG. 5, there is a semi-circular gear 42 on the top of rear wall 37 and a pivot pin (not seen) at the bottom of wall 37. Pivot pin is engaged in a pivot pinhole or seat located at the front bottom edge of ball guide housing 31. There is a pivot pin 43 that engages pivot seat 44 in the front edge of oscillator cover 30. Gear 42 is disposed to engage panning drive gear 46 located in oscillator cover 30. Panning drive gear 46 is driven by a panning servo motor 48 also located in oscillator cover 30. Actuation of servo motor 48 affects side-to-side movement about vertical axis A3, as indicated by arrow D in FIG. 2.

A posterior ball discharge tube section 50 is pivotally mounted in bracket 36 by pivot 52 at ear 38 and by pivot 54 at arcuate gear 40. Posterior ball discharge tube section 50 includes a first stop 56 on the top surface of the tube and a second or lower stop (not seen) on the bottom surface of ball discharge tube section 50. The respective stops delimit up and down motion of the head assembly along arrow C (FIG. 3).

There is an anterior ball discharge tube section 60 rotatably connected around the forward end of posterior tube section 50. The posterior end 62 of anterior ball discharge tube section 60 fits around the forward end of posterior discharge tube 50. As seen in the cross-sectional view of FIG. 7, two Teflon O-ring bushings 64 are placed between the two overlapping sections of the discharge tubes. These bushings permit smooth rotation of the forward discharge tube section around the posterior discharge tube section to effect 180° rotational movements indicated by arrow B in FIG. 2. Also, the Teflon bushings reduce weight conventionally associated with metal ball bearings or the like.

Figure 7:
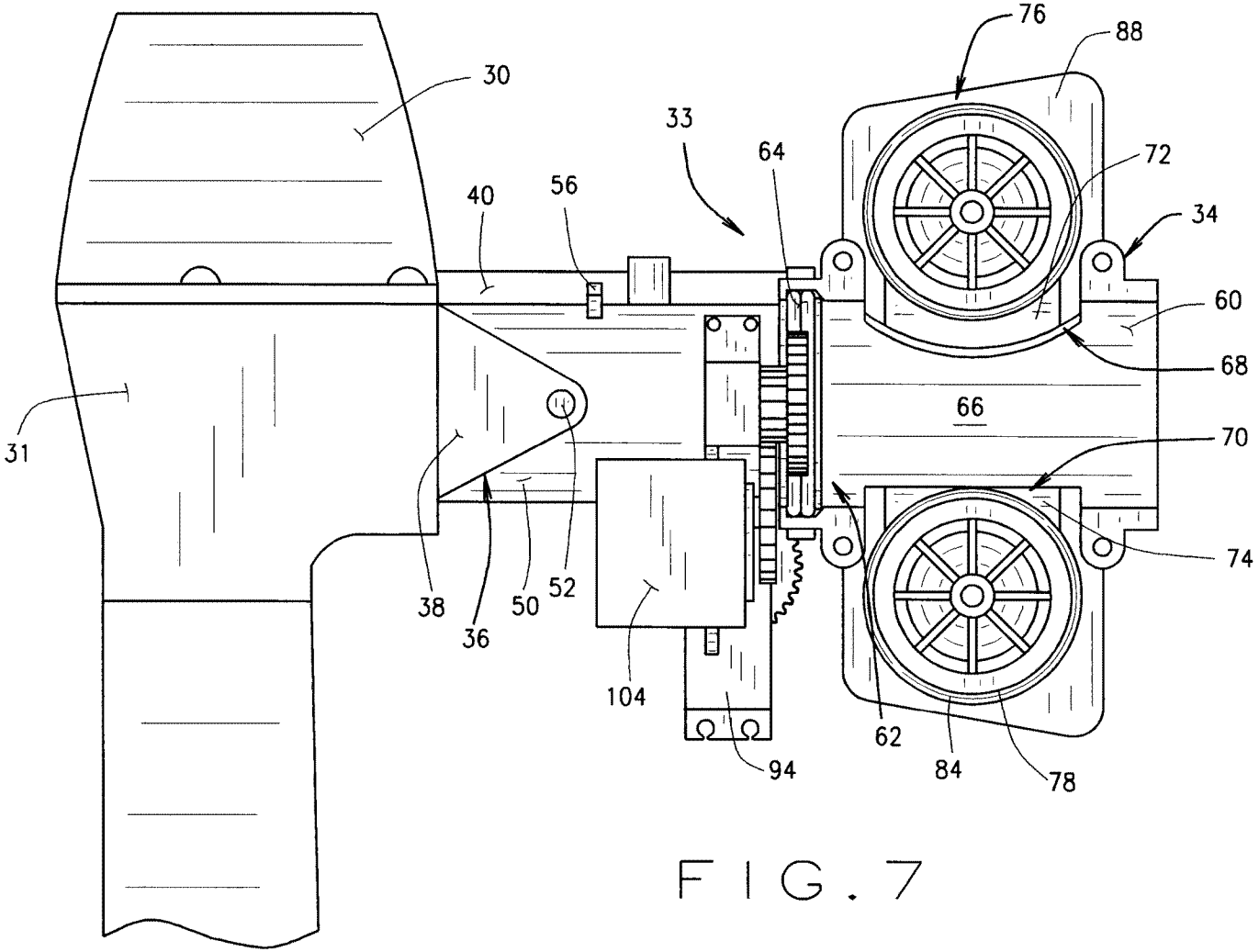
FIG. 7 is partial cross-sectional view taken along line 7-7 of FIG. 3.

The respective discharge tubes cooperate to define a bore 66 sized and configured to accommodate the passage of a ball. FIG. 7 illustrates an aspect of discharge wheels and discharge tube assembly. There is a first opening 68 through forward discharge tube section 60 into bore 66 and an opposed second opening 70 through the wall of forward discharge tube section. There is a first wheel-mounting flange 72 on the wall adjacent the first opening and a second wheel mounting flange 74 on the wall adjacent the second opening. A first discharge wheel 76 is rotatably attached to the first flange and a second discharge wheel 78 is rotatably attached to the second flange. The respective discharge wheels comprise a lightweight material, for example lightweight plastic or the like, which reduces weight and reduces load on the associated drive motors.

As illustrated, wheels 76 and 78 have an axle 79 and outer rims 80, 82. Each rim includes a covering of material 84 having a high coefficient of friction, such as silicone O-ring or the like. The coverings can be applied or preferably they are replaceable, for example, replaceable bands of rubber or O-rings or the like. Wheels 76 and 78 can have more than one rim or O-ring or can have a substantially solid surface of high coefficient of friction material to enhance energy transfer to the ball.

Figure 2:
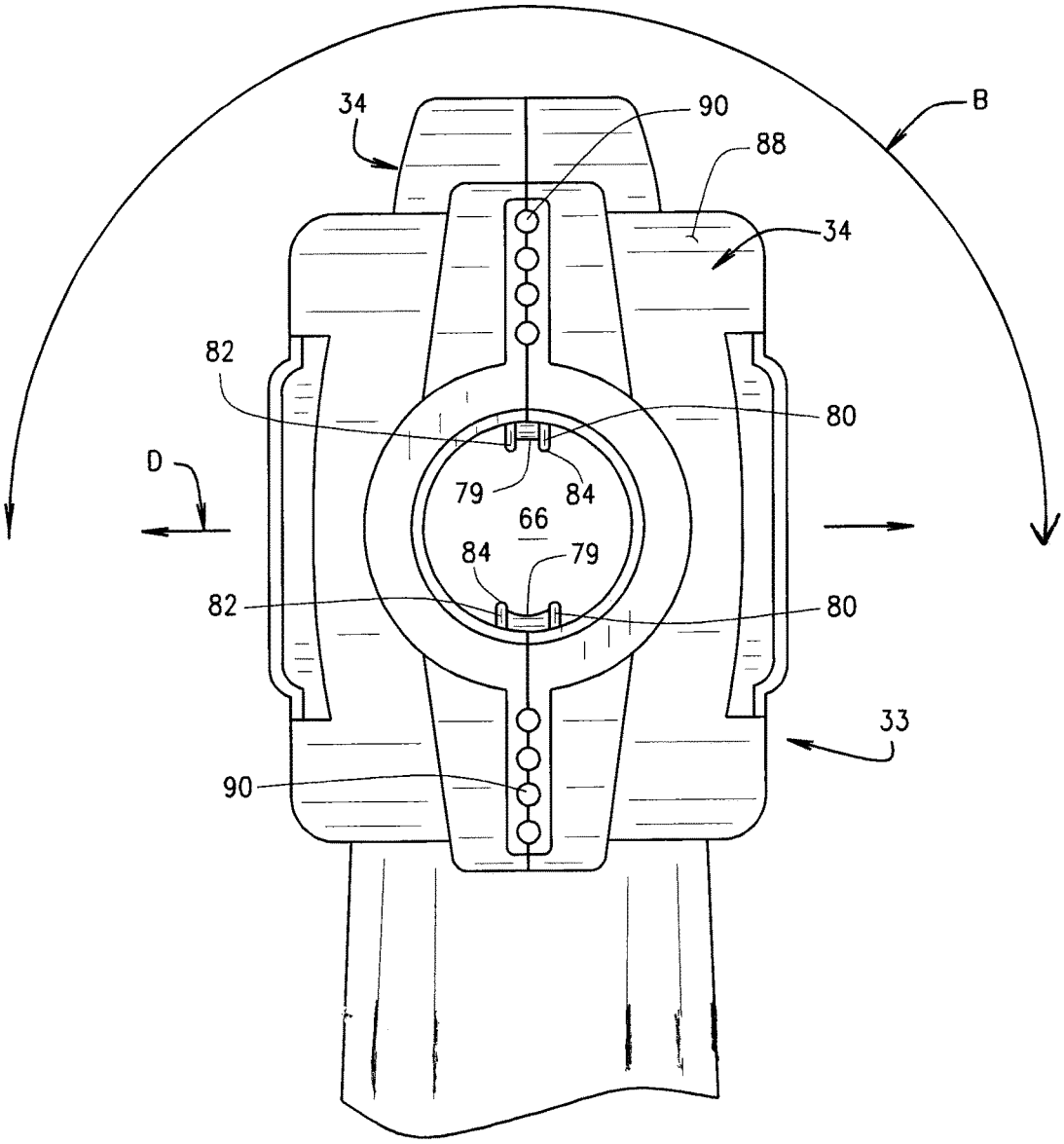
FIG. 2 is a front plan view of the serving head.

As seen in FIG. 2, second discharge wheel 78 has a concave front profile and a material width wider than first wheel 76. This aspect allows a table tennis ball to seat between rims 80 and 82 of the lower wheel for stability. The rims of the respective wheels protrude slightly into bore 66 through openings 68 and 70. Either one or both of the discharge wheels is operatively associated with a small, lightweight motor for turning the wheel(s). In this arrangement the ball enters discharge tube 66, is substantially centered between the rims of the discharge wheels, nesting in the concavity of wheel 78 and propelled through bore 66 and out of the serving head. The O-rings on the wheel rims provide a good friction surface against the balls. Alternatively, the surface of the wheel rims or the wheels themselves may be constructed from a material having a high coefficient of friction. In any event, the wheels contact the ball in four discrete locations of a controllable size. This lends a degree of 'self-centering' as the ball passes through both wheels. The O-rings are also easily replaced as they wear out, avoiding the need to replace a whole wheel as we do today.

A housing 88 encloses the forward discharge tube and wheels. It will be noted that there are a plurality of indicator lights 90 on the face of housing 88. In one aspect there are 4 green LED's and 4 red LED's to indicate the amount of spin on an incoming ball. This feature gives the user a visual clue as to how much spin is on a shot. By comparison, in an actual game, a player determines amount of spin by carefully watching the opponent and ascertaining the paddle angle, stroke angle, and paddle speed at the moment of ball contact. But with a robot it is difficult to determine amount of spin from any sensory input. In general, the number of green LED's that are lit will signal to the user the amount of topspin on the ball (1 LED=light topspin, 4 LED's=heavy topspin), while the number of lit red LED's will signal the amount of backspin. If no LED's are lit then that signals a no-spin (dead) ball.

Figure 6:
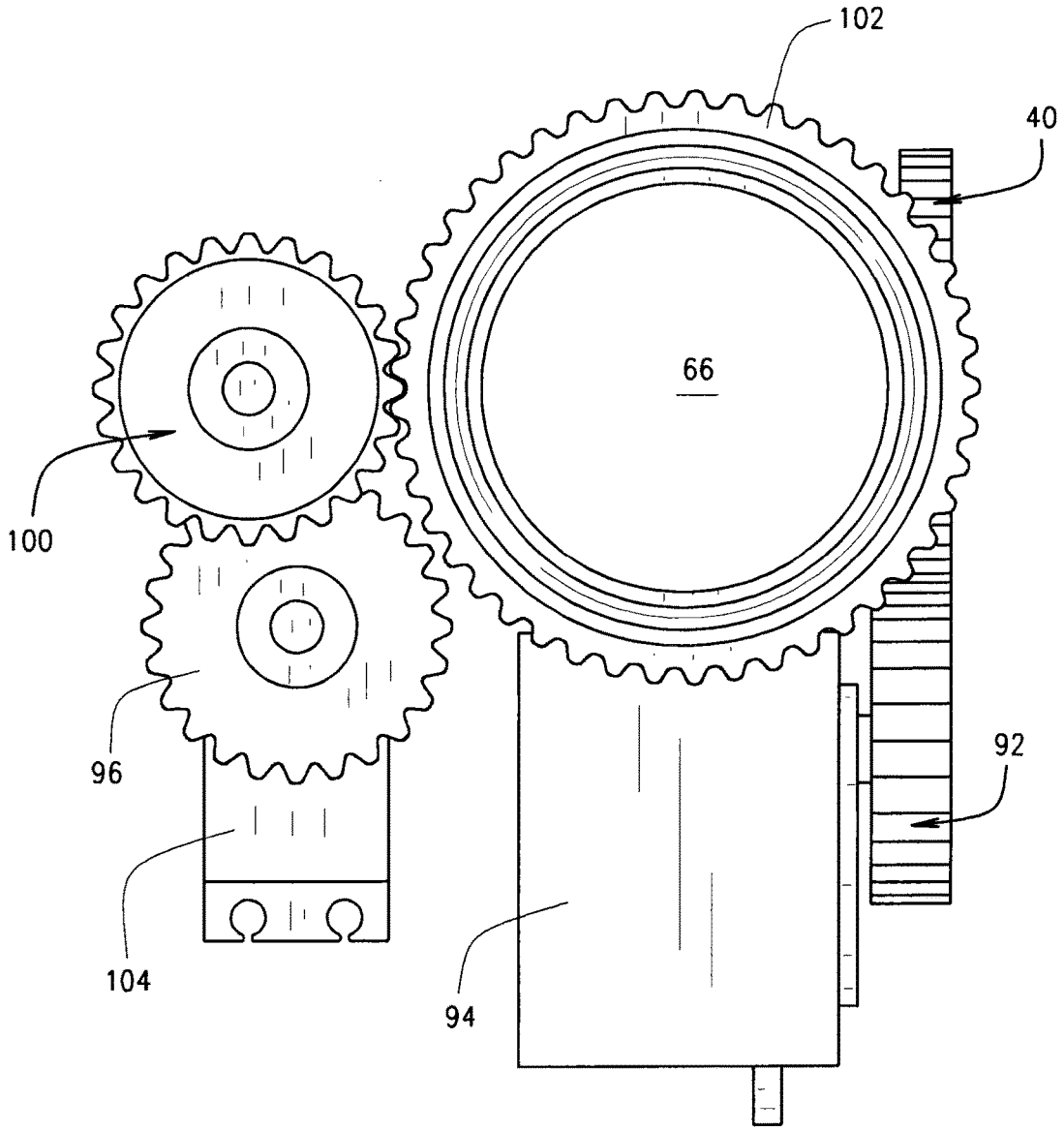
FIG. 6 is a front plan view of the gear and motor cluster taken along line 6-6 of FIG. 5.

A combination of the aforementioned spins may be imparted to the ball. Rotating the head assembly around the longitudinal axis A1 of the discharge tube controls the type of spin imparted to the ball. The discharge head can rotate about 180° as indicated by arrow B in FIG. 2. As the head assembly rotates, the position of the discharge wheels within the head assembly varies accordingly. For example, the discharge wheels can be functionally orientated on the top, bottom, left or right side of the ball and all points in between to vary the spin. Furthermore, as described above the trajectory can be varied by tilting or moving the discharge head up and down along a path indicated by arrow C and back and forth along path indicated by arrow D to offer nearly unlimited variations in ball discharge characteristics. The various elements that effect this movement will now be described with particular reference to FIGS. 5 and 6.

As set out above, panning movement is affected through panning drive gear 46 and semicircular gear 42. Up and down movement along the path defined by arrow C is driven by gear 92, which engages arcuate gear 40 on bracket 36. Gear 92 is operatively attached to servo motor 94. Actuation of motor 94 turns gear 92, which in turn drives the serving head assembly to move up and down around pivots 52 and 54. Rotational movement of the head assembly along the path indicated by arrow B is effected by drive gear 96, which engages concentric step-down gear segment 98 of gear 100. Gear 100 is rotatingly mounted in a bushing 101. There is a main circumferential gear 102 around the exterior of the posterior end of forward discharge tube. Circumferential gear 102 is operatively associated with gear 100. Drive gear 96 is powered by servo motor 104. Actuation of servo motor 104 turns drive gear 96 which in turn drives gear 100 (through step-down gear segment 98) which in turn drives circumferential gear 102.

It will be appreciated that one or more servo motors may be actuated at one time. Hence, actuation of two or more servo motors simultaneously can be affected providing smooth and quiet movement and articulation of the serving head in an unlimited number of ways for an enhanced playing experience.

The various gears preferably are made from durable, lightweight material such as plastic or nylon or other synthetic material, which reduces weight to permit smooth and quiet movement. It will be noted the configuration and size of the various described gears, along with their associated motors, is selected to obtain optimal, varied speed of movement of the ball discharge head along the described paths arrows B-D to vary ball discharge characteristics. The use of small, lightweight servo motors reduces the weight of the serving head assembly to facilitate movement heretofore limited by use of bulky or heavier motors, gears and metal bearings. Moreover, the movement of the serving head can be pre-programmed by the user, as will be described below.

The table tennis robot is operatively connected to a digital controller, as shown in FIG. 2 indicated by reference number 110. In the representative aspect, controller 110 is a tablet computer and comprises a touch screen display 112 used to navigate menus displayed on the display screen and make choices from the menus. The tablet controller 110 uses a menu-based control system which is much more user-friendly system than the switches, dials, levers, and indicators that many other robots use. The controller can be pre-programmed by the manufacturer or allows the user to program the controller as desired.

In any event, one aspect of programmable functions is disclosed in co-pending patent application Ser. No. 13/500,774, which is incorporated herein by reference. Briefly stated, the menu system defaults to a "normal mode" when first turned on. However, the user has the option of changing the default so the robot starts up in a more complex mode, if desired. In any event, normal mode allows control of ball speed, ball frequency (called Wait Time) and oscillation. Additional features may be activated through additional "pages" of normal mode or by switching to Drill mode, where various pre-set patterns of play can be activated. Alternatively, when the digital controller is connected to a Windows personal computer, personal computer mode allows the operation of the robot server assembly to be programmed and controlled directly from the personal computer.

The tablet controller uses Pulse Width Modulation to control motor speeds. This will assure that a full 12 volts (or more) will drive the motors at all times instead of only 1 to 2 volts when potentiometers are set to lowest speeds. This will help prevent ball jamming problems, particularly when new or dirty balls are used in the robot server assembly, and other low voltage problems that can occur with the motors used in accordance with the present disclosure.

The controller allows for setting server head motion and speed and eliminates control levers and control lever adapters. Random settings allow balls to be placed randomly at any position, to vary ball speed to make ball go shorter or deeper on the table, and also for wait time, so it is more difficult to develop a rhythm. This makes the robot server less predictable and more similar to the way a human would play. The controller may be reprogrammed to correct problems or add new capabilities in the future.

Controller 110 can be connected by serial port to a Windows personal computer containing a software program capable of creating "drill files" that can be transferred between users, so for instance, a coach can create 3 drill files for his students to do each day of the current week and then send them new drills after evaluating their progress at the end of that week. Optionally, a community of players with robots can swap files amongst themselves. Drill files will define motor speeds, ball locations, and delay between sequential shots. There is no limit to the number of consecutive balls that can be included in a drill file.

A "Drill" mode will have a set number of standard drills that can be run by the controller without having the digital controller connected to a personal computer. Ball speed and wait time for the drill may be adjusted so a single drill will be suitable for a wide range of playing skills. The number of consecutive balls in a drill is determined by the amount of memory space on the microchip allocated to each drill.

A "Normal" mode allows for individual control over motor speeds and allows for setting the ball locations much more exactly, much finer control over the exact delay between consecutive shots, and being able to stop delivery after either a certain number of balls have been delivered or a certain amount of time has elapsed.

A "Set-Up" mode allows for calibration of settings and selection of options.

The "Count/Time" option allows ball delivery to be controlled by the number of balls (in Normal mode), the number of repetitions (in Drill mode), or the amount of time.

Additionally, wireless communication interfaces such as WiFi or Bluetooth are suitable.

The controller may be appropriately programmed so that the menus in the menu system may be displayed in English, German, French, Spanish, Chinese, and Japanese. There is even a special feature where language can be selected even if the digital controller is already set in a language that the user cannot read.

The controller may be set for left or right hand operation, so that drills run correctly for left-handed or right-handed players. The speed and oscillation can be calibrated to a known standard so that drills written for one robot can be shared, and run correctly, by many other robots. The ball sensor can be calibrated to a particular ball feed mechanism to eliminate missed or delayed pickups or double throws.

The controller may include Factory Default Restoration and Self-Diagnostic special functions that restore settings to the factory default settings and produce troubleshooting codes to allow a technician to quickly tell if the digital controller is functioning properly.

A software program is installed on a personal computer and a connection is made between the PC and the robot controller. The software program allows a user to read and write drills back and forth to the digital controller, to create new drills from scratch, run drills directly from the personal computer, and to save drill files on the personal computer. The software program can also restore all 64 drills stored in the digital controller to the original factory settings.

On the other hand, the table controller may incorporate all the functions of the personal computer.

Drill files may be saved on the tablet controller for later use by selecting the Save command from the File menu. A dialog box will then appear which allows the drill file to be given a distinctive name. Drill files, which have between previously saved, can be recalled using the Open command on the File menu. Selecting the open command will display a dialog box, which allows the user to navigate to a previously saved drill file. Once a drill file is selected, the sequence steps from the drill appear.

The afore disclosed servo motors, LED lights and any other motors required for operation are appropriately electrically wired and connected to source of electricity, for example through a power cord or appropriate battery.

The above examples show that the disclosure, as defined by the claims, has far ranging application and should not be limited merely to the embodiments shown and described in detail. Instead, the disclosure should be limited only to the explicit words of the claims, and the claims should not be limited to the detailed embodiments shown in the specification, which represent the best modes of the disclosure and not the extents of protection. The scope of protection is only limited by the scope of the accompanying claims, and the Examiner should examine the claims on that basis.

The invention claimed is:

1. A robot server assembly for serving table tennis balls comprising:

a body with an upper end and a lower end, said body defining an internal ball path;

ball pickup apparatus for introducing balls into the internal ball path at the lower end of the body;

a ball guide at the upper end of the internal ball path, said ball guide having an open bottom in communication with the internal ball path and an open front;

a serving head assembly attached to the upper end of the body and having a serving head with a ball discharge tube in communication with the open front of the ball guide;

a pair of opposed discharge wheels operatively associated with the discharge tube;

wherein the robot server assembly further comprises:

a panning servo motor configured to actuate, a panning drive gear operatively associated with the panning servo motor and with a semi-circular gear which engages with the panning drive gear and operatively associated with the serving head assembly to affect side-to-side movement of the serving head assembly about a vertical axis;

an up/down servo motor configured to actuate an up/down drive gear operatively associated with the up/down servo motor and with an arcuate gear which engages with the up/down drive gear and which is operatively associated with the serving head assembly to affect up/down movement of the serving hand assembly; and, a rotational servo motor configured to actuate a first rotational drive gear operatively associated with the rotational servo motor and engaging a step-down gear segment of a second rotational drive gear, which in turn engages a circumferential gear operatively associated with the serving head assembly to actuate rotation of said serving head assembly about a longitudinal axis of the serving head;

whereby, as movement of the serving head is actuated, the position of the discharge wheels relative to the longitudinal axis and the vertical axis varies so that the discharge wheels can be functionally orientated on the top, bottom, left or right side of a ball and all points in between to vary the spin from no-spin to heavy to light topspin to light to heavy backspin.

2. The robot server assembly of claim 1 wherein rotational movement, up and down movement and side-to-side movement can be actuated in combination.

3. The robot server assembly of claim 1 wherein the discharge tube has an anterior section and a posterior section in rotatable engagement.

4. The robot server assembly of claim 3 having a bushing between the anterior section and posterior section of the discharge tube.

5. The robot server assembly of claim 4 wherein the bushing is a Teflon O-ring.

6. The robot server assembly of claim 1 wherein each discharge wheel has a pair of opposed rims, each said rim having a high coefficient of friction.

7. The robot server assembly of claim 6 wherein one of the discharge wheels has a width greater than the width of the other of the discharge wheels.

8. The robot server assembly of claim 7 wherein the discharge wheel having the greater width has a concave profile.

9. The robot server assembly of claim 1 further comprising a tablet computer controller that operates functions of the robot server assembly from a menu of functions.

10. The robot server assembly of claim 1 wherein the ball pickup apparatus is a rotating ball pickup apparatus.

11. The robot server assembly of claim 10 wherein the ball pickup apparatus further comprises outwardly orientated extensions for engaging table tennis balls at the lower end of the body.

12. The robot server assembly of claim 1 wherein the at least one gear operatively associated with the serving head assembly to actuate the serving head assembly in a side-to-side manner is a semi-circular gear.

13. The robot server of claim 1 wherein the at least one gear which is operatively associated with the at least one servo motor and is further operatively associated with the serving head assembly to actuate the serving head assembly in an up-and-down manner is at least two gears comprising at least a circular gear operatively associated with an arcuate gear.

14. A robot server assembly for serving table tennis balls comprising:

a body with an upper end and a lower end, said body defining an internal ball path;

ball pickup apparatus for introducing balls into the internal ball path at the lower end of the body;

a ball guide at the upper end of the internal ball path, said ball guide having an open bottom in communication with the internal ball path and an open front;

a serving head assembly attached to the upper end of the body having a ball discharge tube in communication with the open front of the ball guide;

a pair of opposed discharge wheels operatively associated with the discharge tube;

at least one servo motor operatively associated with at least one semi-circular gear operatively associated with the serving head assembly to actuate the serving head assembly in a side-to-side manner;

at least one circular gear which is operatively associated with at least one arcuate gear and which in turn is operatively associated with the at least one servo motor and is further operatively associated with the serving head assembly to actuate the serving head assembly in an up-and-down manner;

the at least one servo motor operatively associated with a drive gear which is operatively associated with a circumferential gear which in turn is operatively associated with the serving head assembly to actuate rotation of said serving head assembly;

wherein the at least one servo motor which actuates the serving head assembly in each of a side-to-side, up-and-down and rotational manner may be the same or different at least one servo motor; and wherein the rotational movement, up and down movement and side-to-side movement of the server head assembly can be actuated in combination; and wherein the discharge wheels are associated with indicator lights which give a visual signal to indicate the degree and direction of spin placed on a ball.

* * * * *